US007158732B2

(12) United States Patent
Mo et al.

(10) Patent No.: US 7,158,732 B2
(45) Date of Patent: Jan. 2, 2007

(54) METHOD AND SYSTEM FOR USING TONER CONCENTRATION AS AN ACTIVE CONTROL ACTUATOR FOR TRC CONTROL

(75) Inventors: Song-Feng Mo, Webster, NY (US); Jennifer R. Wagner, Walworth, NY (US); Wendy K. Apton, Webster, NY (US); Stephen F. Randall, West Henrietta, NY (US); Patricio G. Medina, Rochester, NY (US); Patrick J. Walker, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/033,223

(22) Filed: Jan. 11, 2005

(65) Prior Publication Data

US 2006/0153582 A1 Jul. 13, 2006

(51) Int. Cl.
*G03G 15/00* (2006.01)

(52) U.S. Cl. ..... 399/49; 399/53; 399/60

(58) Field of Classification Search ..... 399/49
See application file for complete search history.

(56) References Cited

U.S. PATENT DOCUMENTS 4,553,033 A 11/1985 Hubble, III et al.
4,989,985 A 2/1991 Hubble, III et al.
5,204,538 A 4/1993 Genovese
5,227,270 A * 7/1993 Scheuer et al. ..... 399/290
5,436,705 A * 7/1995 Raj ..... 399/59
5,710,958 A 1/1998 Raj
5,895,141 A 4/1999 Budnik et al.
6,035,152 A * 3/2000 Craig et al. ..... 399/49
6,198,886 B1 * 3/2001 Brewington ..... 399/49
6,285,840 B1 9/2001 Budnik et al.
6,426,630 B1 7/2002 Werner, Jr.
6,580,882 B1 6/2003 Hirsch et al.
6,694,109 B1 2/2004 Donaldson et al.
6,741,816 B1 5/2004 Shim et al.
6,771,912 B1 8/2004 Mo et al.
6,792,220 B1 9/2004 Randall et al.

* cited by examiner

*Primary Examiner*—David M. Gray
*Assistant Examiner*—Ryan D. Walsh
(74) *Attorney, Agent, or Firm*—Fay, Sharpe, Fagan, Minnich & McKee, LLP

(57) ABSTRACT

A method of using toner concentration (TC) as an active actuator in the tonal reproduction curve (TRC) controller, so that not only will the TRC controller maintain the TRC of the output, but also all the electrostatic actuators will not diverge, and the toner concentration will be within the latitude range of the xerographic system. The process ensures that the target of the toner concentration (TC) sensor will be changed properly in direction (up/down) and amplitude to compensate the TRC output of the print engine based on either reflective reactance readings and/or the level of the electrostatic actuators.

14 Claims, 4 Drawing Sheets

METHOD AND SYSTEM FOR USING TONER CONCENTRATION AS AN ACTIVE CONTROL ACTUATOR FOR TRC CONTROL

BACKGROUND

The present exemplary embodiment relates generally to electrophotographic printing. It finds particular application in conjunction with controlling the tonal reproduction curve (TRC) and maintaining toner concentration (TC) within the latitude range of the electrophotographic print system, and will be described with particular reference thereto. However, it is to be appreciated that the present exemplary embodiment is also amenable to other like applications.

In copying or printing systems, such as a xerographic copier, laser printer, or printer, a common technique for monitoring the quality of prints is to artificially create a "test patch" of a predetermined desired density. The actual density of the toner or ink in the test patch can then be optically measured to determine the effectiveness of the printing process in placing this toner on the print sheet. In the case of xerographic devices, the surface that is typically of most interest in determining the density of toner thereon is the charge-retentive surface or photoreceptor, on which the electrostatic latent image is formed and subsequently, developed by causing toner particles to adhere to areas thereof that are charged in a particular way. In such a case, the optical device for determining the density of toner on the test patch, which is often referred to as a "densitometer," is disposed along the path of the photoreceptor, directly downstream of the development of the development unit. There is typically a routine within the operating system of the printer to periodically create test patches of a desired density at predetermined locations on the photoreceptor by deliberately causing the exposure system thereof to charge or discharge as necessary the surface at the location to a predetermined extent.

The test patch is then moved past the developer unit and the toner particles within the developer unit are caused to adhere to the test patch electrostatically. The denser the toner on the test patch, the darker the test patch will appear in optical testing. The developed test patch is moved past a densitometer disposed along the path of the photoreceptor, and the light absorption of the test patch is tested—the more light that is absorbed by the test patch, the denser the toner on the test patch. Xerographic test patches are traditionally printed in the interdocument zones on the photoreceptor. They are used to measure the deposition of toner on paper to measure and control the tonal reproduction curve (TRC). Generally each patch is about an inch square that is printed as a uniform solid half tone or background area. This practice enables the sensor to read values on the tonal reproduction curve for each test patch.

The process controls that are generally monitored include developability, which is the rate at which development (toner mass/area) takes place. Developability is typically monitored (and thereby controlled) using infrared densitometers (IRDs) and by measuring toner concentration (TC) in the developer housing. As described above, IRDs measure total developed mass (i.e., on the imaging member), which is a function of developability and electrostatics. Thus, the developability cannot be determined using IRDs alone because the electrostatics of the imaging member also affects the mass of toner deposited on the imaging member by a developer device. Toner concentration is measured by directly measuring the percentage of toner in the developer housing (which, as is well known, contains toner and carrier particles). However, the relationship between TC and developability is affected by other variables such as ambient temperature, humidity and the age of the toner. For example, a 3% TC results in different developabilities depending on the variables listed above. Thus, maintaining toner concentration at a predetermined value does not ensure a desired developability.

Thus, in xerographic print engines, a TRC controller is critical to the image quality of the output. In recent years, in order to better control image quality of the output of a print engine, most middle to high end products have started to control TRC using a three-point target in TRC controller, i.e. solid, mid-tone and highlight. This is a change from the previous one-point target (solid only) or two-point target (solid and highlight). Adding the new point in the mid-tone area has added complexity to the TRC controller. Convergence of the electrostatic actuators by the TRC controller depends on factors such as the hardware, TRC control algorithms, and the environment and toner concentration in the development housing. Toner concentration is a critical factor in making the TRC controller work well and keeping the xerographic system within latitude. In the past some machines used a constant toner concentration target. Other machines used toner concentration target per environment change. For these machines, the toner concentration target used in toner concentration control is independent of TRC control. This strategy works most of the time, but there are situations where the TRC is "bent."

A "bent" TRC is illustrated in FIG. 1. TRC control generally provides uniform gray scale development and effective translation of halftones, highlights, and shadow details, as well as mid-tone densities. The control stability of all the density levels on the TRC makes photographic reproductions and other halftone documents invariant from machine-to-machine and copy-to-copy. Referring to FIG. 1, the TRC is shown in terms of a measure of whiteness (L*) versus the toner area coverage ($C_{in.}$) of developed image fill patterns. L* represents the differential response of the human eye to a developed image and is used as a metric for density variation. Since L* is non-linear in terms of density, density information for values of $C_{in.}$ are converted to L* as explained in U.S. Pat. No. 5,436,705 at column 5, lines 56–68, and column 6, lines 1–11. The variations in the L* values shown in FIG. 1 are typically controlled to a standard deviation of plus or minus 2 units or 2 sigma-limits. The standard deviation is indicated graphically by a space defined between the two opposing solid lines adjacent to the bent TRC. The upper and lower boundaries are used to decide if image quality is satisfactory. If the image quality is above the upper boundary or below the lower boundary, it will not pass the set-up mode.

In the situation where the TRC is "bent," (i.e., the solid patch is too light and the mid-tone patch is too dark or the solid patch is too dark and the mid-tone patch is too light), without moving toner concentration per the TRC controller, there are typically two choices: compromise the TRC of the output prints or drive the electrostatic actuators to the point of divergence. When the TRC is "bending" and the toner concentration does not move, this will normally drive electrostatic actuators to the point of divergence in order to keep the TRC within tolerance, or the TRC will be compromised if the actuators are restrained from moving. When the actuators diverge, the TRC of the output will either be out of specification or the TRC controller may fault and cause the machine to cycle down. The end result will be that customers will either have to make a service call or they will have compromised image quality.

Thus, there is a need for an improved method and system for using a TRC controller to change the target of the toner concentration sensor and use toner concentration as an active actuator to compensate for the bending of the output TRC is needed. Such a method and system would change toner concentration properly, so that the TRC bending issue will be resolved without causing any system latitude issues. The improved method and system would change toner concentration properly in both amplitude and direction, based on either the level of the electrostatic actuators or the difference between the target and readings of the relative reflectance (RR) from the black toner area coverage (BTAC) sensor. This improved method and system would also ensure that the TRC will be controlled without driving the electrostatic actuators to divergence and the toner concentration will be maintained within the range of the xerographic system latitude requirements.

BRIEF DESCRIPTION

A purpose of this exemplary embodiment is to use toner concentration as an active actuator in the TRC controller, so that not only will the TRC controller maintain the TRC of the output, but also all the electrostatic actuators will not diverge, and the toner concentration will be within the latitude range of the xerographic system. One element of this exemplary embodiment is a process to ensure that the target of the toner concentration sensor will be changed properly in direction (up/down) and amplitude to compensate the TRC output of the print engine based on either reflective reactance readings and/or the level of the electrostatic actuators. In the meantime, toner concentration is not changed too dramatically to cause any potential xerographic system issues such as excess toner emissions, which can lead to background streaks or other image quality defects or, conversely, too little TC, which can lead to light prints.

In accordance with one aspect of the present exemplary embodiment,there is provided a method of controlling the tonal reproduction curve (TRC) and maintaining toner concentration (TC) within the latitude range of an electrophotographic print engine having a TC target and a predetermined actuator margin. The method comprises: receiving data from a sensor; determining whether any one of a first set of conditions exists; setting a predetermined TC target to tone TC down by delta TC, where any one of the first set of conditions exists; determining whether any of any of a second set of conditions exists; and setting the TC target to tone TC down by delta TC, where any one of the second set of conditions exists.

In accordance with another aspect of the present exemplary embodiment there is provided a system for controlling the tonal reproduction curve (TRC) and maintaining toner concentration (TC) of a print engine having a TC target and a predetermined actuator margin. The system comprises an electrostatic voltmeter; an infrared densitometer; a TC sensor; and software means operative on the print engine for receiving data from the infrared densitometer; determining whether any one of a first set of conditions exists; setting the TC target to tone TC down by delta TC, where any one of the first set of conditions exists; determining whether any of any of a second set of conditions exists; and setting the TC target to tone TC down by delta TC, where any one of the second set of conditions exists.

DETAILED DESCRIPTION

Figure 1:
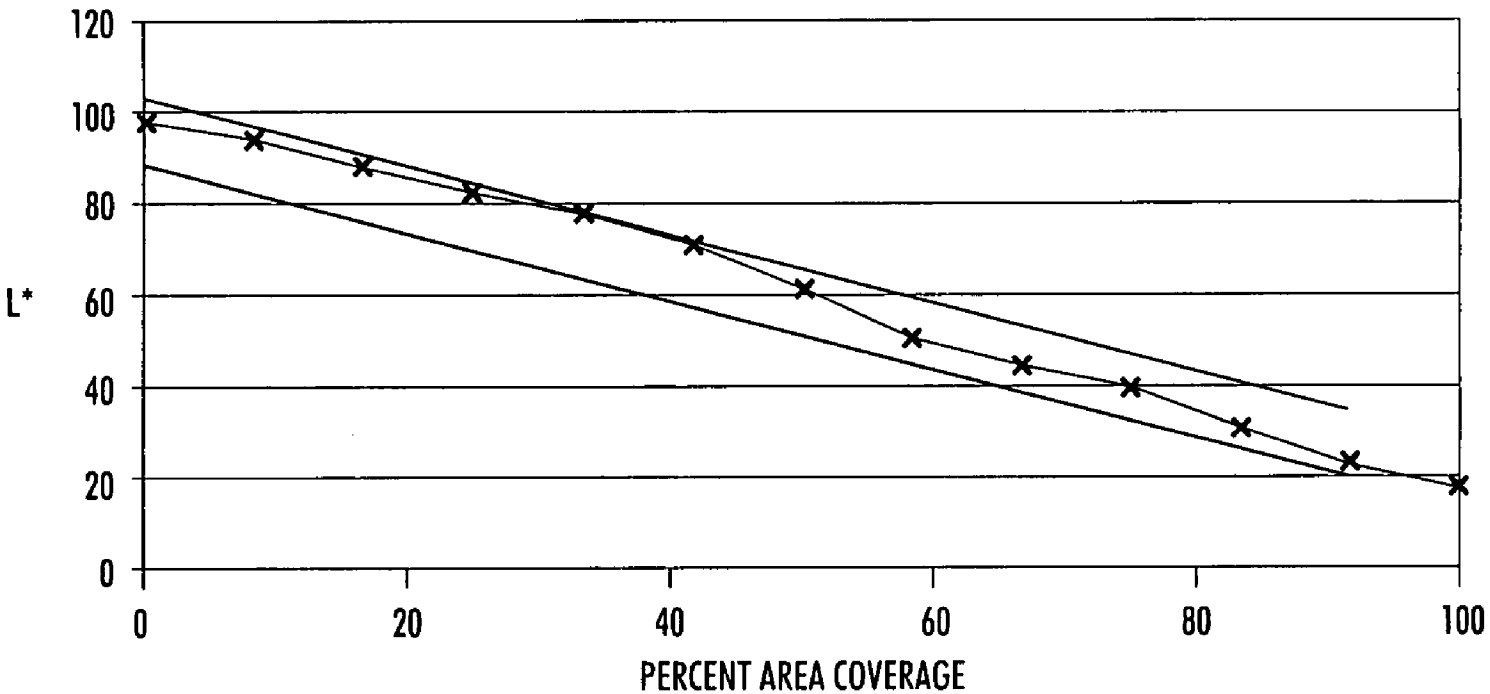
FIG. 1 shows an example of a "bent" TRC curve.
Figure 2:
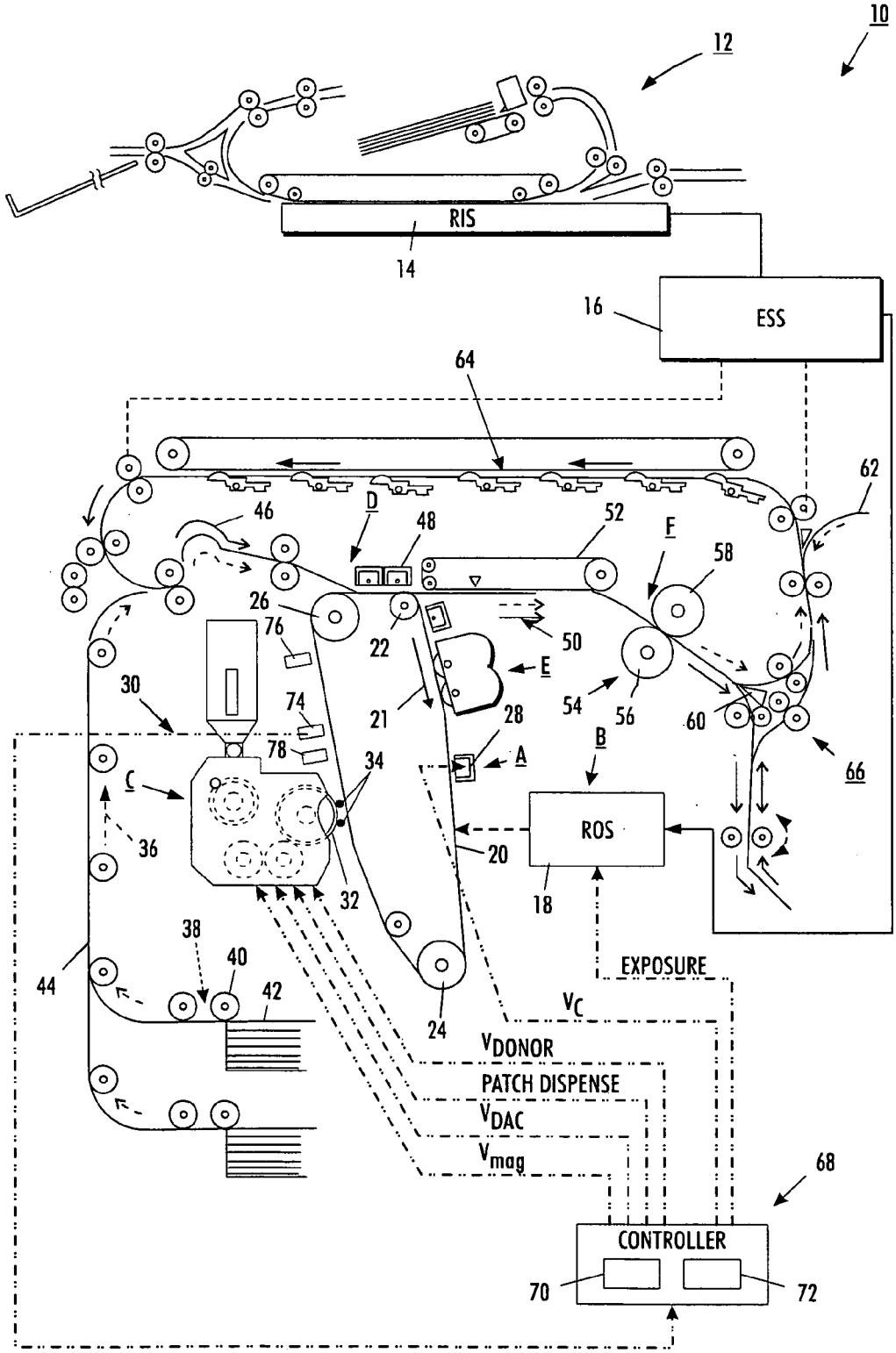
FIG. 2 is a schematic, elevational view showing an electrophotographic printing machine incorporating aspects of the present exemplary embodiment.

For a general understanding of the features of the present exemplary embodiment, reference is made to the drawings, wherein like reference numerals have been used throughout to designate identical elements. FIG. 2 schematically depicts the various elements of an illustrative electrophotographic printing machine 10 incorporating the method of the present exemplary embodiment therein. It will become evident from the following discussion that this method is equally well suited for use in a wide variety of printing machines and is not necessarily limited in its application to the particular embodiment depicted herein. Inasmuch as the art of electrophotographic printing is well known, the various processing stations employed in the printing machine (or print engine) 10 will be shown hereinafter and their operation described briefly with reference thereto.

Referring to FIG. 2, an original document is positioned in a document handler 12 on a raster input scanner (RIS) 14. The RIS 14 contains document illumination lamps, optics, a mechanical scanning drive, and a charge-coupled device (CCD) array. The RIS 14 captures the entire original document and converts it to a series of raster scan lines. This information is transmitted to an electronic subsystem (ESS) 16, which controls a raster output scanner (ROS) 18 described below.

Generally, a photoconductive belt 20 is made from a photoconductive material coated on a ground layer, which, in turn, is coated on an anti-curl backing layer. The belt 20 moves in the direction of arrow 21 to advance successive portions sequentially through the various processing stations disposed about the path movement thereof. The belt 20 is entrained about a stripping roller 22, a tensioning roller 24, and a drive roller 26. As the drive roller 26 rotates, it advances the belt 20 in the direction of arrow 21.

Initially, a portion of the photoconductive surface passes through charging station A, where a corona generating device 28 charges the photoconductive surface of the belt 20 to a relatively high, substantially uniform potential.

At exposure station B, the controller or electronic subsystem (ESS) 16 receives the image signals representing the desired output image and processes these signals to convert them to a continuous tone or gray-scale rendition of the image which is transmitted to a modulated output generator, for example the ROS 18. Preferably, the ESS 16 is a self-contained, dedicated minicomputer. The image signals transmitted to the ESS 16 may originate from the RIS 14 as described above or from a computer, thereby enabling the electrophotographic printing machine 10 to serve as a remotely located printer for one or more computers. Alternatively, the printer may serve as a dedicated printer for a high-speed computer. The signals from the ESS 16, corresponding to the continuous tone image desired to be reproduced by the printing machine, are transmitted to the ROS 18. The ROS 18 includes a laser with rotating polygon mirror blocks. The ROS 18 will expose the photoconductive belt to record an electrostatic image thereon corresponding to the continuous tone image received from the ESS 16. As an alternative, the ROS 18 may employ a linear array of light emitting diodes (LEDs) arranged to illuminate the charged portion of the photoconductive belt 20 on a raster-by-raster basis.

After the electrostatic latent image has been recorded on the photoconductive surface of the belt 20, the belt 20 advances the latent image to a development station C where, a development system 30 develops the latent image. Preferably, the development system 30 includes a donor roll 32, a magnetic transfer roll, and electrode wires 34 positioned in a gap between the donor roll 32 and the photoconductive belt 20. The magnetic transfer roll delivers toner to a loading zone (not shown) located between the transfer roll and the donor roll 32. The transfer roll is electrically biased relative to the donor roll 32 to affect the deposited mass per unit area (DMA) of toner particles from the transport roll to the donor roll 32. One skilled in the art will realize that both the donor roll and magnetic transfer roll have A.C. and D.C. voltages superimposed thereon. The electrode wires 34 are electrically biased relative to the donor roll 32 to detach toner therefrom and form a toner powder cloud in the gap between the donor roll 32 and the photoconductive belt 20. The latent image attracts toner particles from the toner powder cloud forming a toner powder image thereon.

With continued reference to FIG. 2, after the electrostatic latent image is developed, the toner image present on the belt 20 advances to transfer station D. A print sheet 36 is advanced to the transfer station D by a sheet feeding apparatus 38. Preferably, the sheet feeding apparatus 38 includes a feed roll 40 contacting the upper most sheet from stack 42. The feed roll 40 rotates to advance the uppermost sheet from the stack 42 into a vertical transport 44. The vertical transport 44 directs the advancing sheet 36 of support material into a registration transport 46 past image transfer station D to receive an image from the belt 20 in a timed sequence so that the toner powder image formed thereon contacts the advancing sheet at transfer station D. Transfer station D includes a corona generating device 48, which sprays ions onto the back side of the sheet 36. This attracts the toner powder image from the photoconductive surface of the belt 20 to the sheet 36. After transfer, the sheet 36 continues to move in the direction of arrow 50 by way of a belt transport 52, which advances the sheet 36 to fusing station F.

Fusing station F includes a fuser assembly 54, which permanently affixes the transferred toner powder image to the copy sheet 36. Preferably, the fuser assembly 54 includes a heated fuser roller 56 and a pressure roller 58, with the powder image, on the copy sheet 36, contacting the fuser roller 56.

The sheet 36 then passes through the fuser 54, where the image is permanently fixed or fused to the sheet 36. After the sheet 36 passes through the fuser 54, a gate 60 either allows the sheet 36 to move directly via an output 62 to a finisher or stacker, or deflects the sheet into the duplex path 64, specifically, into a single sheet inverter 66. That is, if the sheet 36 is either a simplex sheet, or a completed duplex sheet having both side one and side two images formed thereon, the sheet 36 will be conveyed via the gate 60 directly to the output 62. However, if the sheet 36 is being duplexed and is then only printed with a side one image, the gate 60 will be positioned to deflect that sheet 36 into the inverter 66 and into the duplex loop path 64, where that sheet 36 will be inverted and then fed for recirculation back through transfer station D and the fuser 54 for receiving and permanently fixing the side two image to the backside of that duplex sheet, before it exits via path 62.

After the copy sheet is separated from the photoconductive surface of the belt 20, the residual toner/developer and paper fiber particles adhering to the photoconductive surface are removed at cleaning station E. Cleaning station E includes a rotatably mounted fibrous brush in contact with the photoconductive surface of the belt 20 to disturb and remove paper fibers and a cleaning blade to remove the non-transferred toner particles. The blade may be configured in either a wiper or doctor position depending on the application. Subsequent to cleaning, a discharge lamp (not shown) floods the photoconductive surface of the belt 20 to dissipate any residual electrostatic charge remaining thereon prior to the charging thereof for the next successive imaging cycle.

The various machine functions are regulated by the ESS 16. The ESS 16 is preferably a programmable microprocessor, which controls all the machine functions described above. The ESS 16 provides a comparison count of the copy sheets, the number of documents being recirculated, the number of copy sheets selected by an operator, time delays, jam corrections, and etc. The control of all the exemplary systems described above may be accomplished by conventional control switch inputs from the printing machine console, as selected by the operator. Conventional sheet path sensors or switches may be utilized to keep track of the position of the original documents and the copy sheets.

In electrophotographic printing, toner material changes in the development system 30 and changes in the photo induced discharge characteristics (PIDC) in the photoconductive belt 20 influence the process. Aging and environmental conditions (i.e., temperature and humidity) cause these changes. For example, after 200,000 copies, the PIDC of the photoconductive belt 20 is substantially different than it was when new. The tribo-electric charge on the toner material decays when the machine remains in non-print making condition. An idle period of 2–4 days reduces the charge by 8–10 tribo units. Thus, the machine has a set-up mode to adjust image quality output under different environmental conditions and age before real-time printing begins. The set-up mode does not pass paper through the machine. Instead it sets a plurality of nominal actuator values and sequentially performs one or more adjustment loops to obtain convergence on acceptable image quality parameters.

In FIG. 2, there is provided an adaptive controller 68 that adjusts image quality during the set-up mode. The adaptive controller 68 has a plurality of outputs comprising state variables used as actuators to control a tonal reproduction curve (TRC). The real-time operation of the controller 68 is described in U.S. Pat. No. 5,436,705, which is incorporated by reference herein. The adaptive controller 68 may include a linear quadratic controller 70 and a parameter identifier 72 that divides the controller into the tasks of parameter identification and control modification. The state variable outputs of controller 68 include $V_C$, EXPOSURE, PATCH DISPENSE, $V_{DONOR}$, $V_{mag}$ and $V_{DAC}$. These outputs function as control actuators. Thus, $V_C$ controls a power supply output (not shown) for the corona generating device 28. EXPOSURE controls the exposure intensity delivered by the ROS 18. PATCH DISPENSE controls the amount of dispensed toner required to compensate for toner test patch variations. $V_{DONOR}$ and $V_{DAC}$ control DC and AC power supply voltages (not shown) applied to the donor roll 32, respectively. $V_{mag}$ controls a DC power supply voltage (not shown) applied to the magnetic transfer roll in developer system. Control algorithms for the linear quadratic controller 70 and the parameter identifier 72 process information and adjust the state variables to achieve acceptable image quality during the set-up mode of machine operation.

In various exemplary embodiments, the changes in output generated by the controller 68 are measured by a black toner area coverage (BTAC) sensor 74. The BTAC sensor 74 is located after development station C. It is an infrared reflectance type densitometer that measures the density of toner particles developed on the photoconductive the surface of belt 20. The manner of operation of the BTAC sensor 74 is described in U.S. Pat. No. 4,553,033, which is incorporated by reference herein.

It should be understood that the term black toner area coverage sensor or "densitometer" is intended to apply to any device for determining the density of print material on a surface, such as a visible-light densitometer, an infrared densitometer, an electrostatic voltmeter, or any other such device which makes a physical measurement from which the density of print material may be determined.

As shown FIG. 2, the electrophotographic printing machine 10 also preferably includes an electrostatic voltmeter (ESV) 76. The ESV 76 measures the voltage potential of control patches on the photoconductive surface 20 of the belt or drum. An example of a suitable ESV 76 is described in U.S. Pat. No. 6,426,630, which is incorporated by reference herein. A toner concentration (TC) sensor 78 senses the toner concentration in the developer structure.

Figure 3:
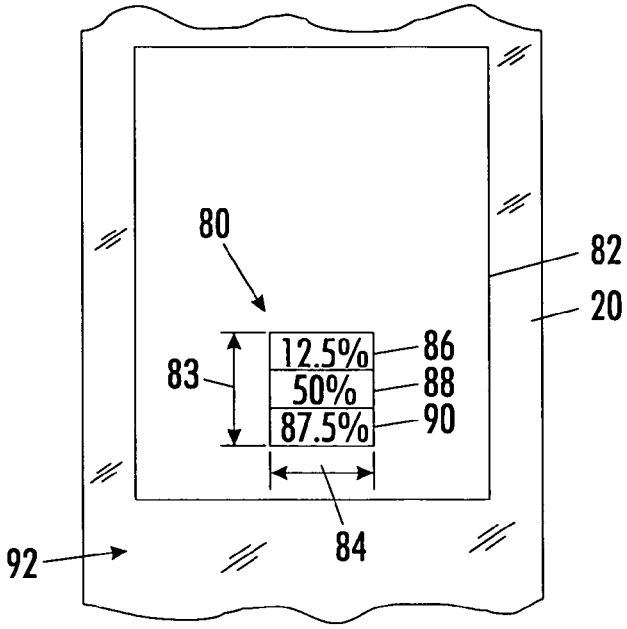
FIG. 3 shows a composite toner test patch recorded in the image zone of the photoconductive member of the machine in FIG. 2.

Referring to FIG. 3, a composite toner test patch 80 is shown in an image area 82 of the photoconductive surface 20. The test patch 80 is that portion of the photoconductive surface 20 sensed by the BTAC sensor 74 to provide the necessary feedback signals for the set up mode. The composite patch 80 may measure, for example, 15 millimeters, in the process direction (indicated by arrow 83), and 45 millimeters, in the cross-process direction (indicated by arrow 84). The patch 80 consists of a segment 86 for highlight density (12.5%), a segment 88 for half-tone density (50%), and a segment 90 for solid area density (87.5%). Before the BTAC sensor 74 can provide a meaningful response to the relative reflectance of the patch segments, it must be calibrated by measuring the light reflected from a bare or clean area portion 92 of photoconductive surface 20. For sensor calibration purposes, current flow is increased until the voltage generated by the BTAC sensor 74 (in response to light reflected from area 92) is between 3 and 5 volts.

In order to offer customers value-added diagnostic services using add-on hardware and software modules which provide service information on copier/printer products, a hierarchy of machine servers may be used in accordance with this exemplary embodiment. In the following, "machine" is used to refer to the device whose performance is being monitored, including, but not limited to, a copier or printer. "Server" is used to refer to the device(s) that perform the monitoring and analysis function and provide the communication interface between the "machine" and the service environment. Such a server may comprise a computer with ancillary components, as well as software and hardware parts to receive raw data from various sensors located within the machine at appropriate, frequent intervals, on a continuing basis and to interpret such data and report on the functional status of the subsystem and systems of the machine. In addition to the direct sensor data received from the machine, knowledge of the parameters in the process control algorithms is also passed in order to acknowledge the fact that process controls attempt to correct for machine parameter and materials drift and other image quality affecters.

Figure 4:
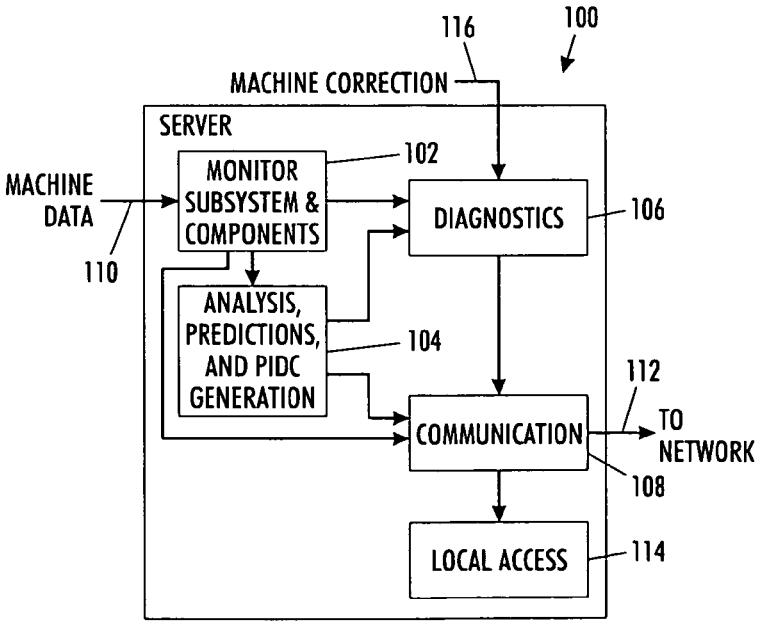
FIG. 4 is a schematic view of a machine server and interface in accordance with aspects of the present exemplary embodiment.

In the exemplary embodiment shown in FIG. 4, a server 100 includes a subsystem and component monitor 102, an analysis and predictions component 104, a diagnostic component 106 and a communication component 108. It should be understood that suitable memory may be included in the server 100, the monitor 102, the analysis and predictions component 104, the diagnostics component 106 and the communication component 108. The monitor 102 contains a preprocessing capability including a feature extractor which isolates the relevant portions of data to be forwarded on to the analysis and diagnostic elements. In general, the monitor 102 receives machine data, as illustrated at 110, and provides suitable data to the analysis and predictions component 104 to analyze machine operation and status and track machine trends such as usage of disposable components as well as usage data, and component and subsystem wear data. Diagnostic component 106 receives various machine sensor and control data from the monitor 102, as well as data from the analysis and predictions component 104 to provide immediate machine correction, as illustrated at 116, as well as to provide crucial diagnostic and service information through communication component 108, for example, via a line 112 to an interconnected network to a remote server on the network or to a centralized host machine with various diagnostic tools such as an expert system. Such information may include suitable alarm condition reports, requests to replenish depleted consumable, and data sufficient for a more thorough diagnostics of the machine. A local access 114 or interface for a local service representative may be provided to access various analysis, prediction, and diagnostic data stored in the server 100, as well as to interconnect any suitable diagnostic device.

The idea of "print quality" can be quantified in a number of ways, but two key measurements of print quality are (1) the solid area density, which is the darkness of a representative developed area intended to be completely covered by toner and (2) a halftone area density, which is the copy quality of a representative area which is intended to be, for example, 50% covered with toner. The halftone is typically created by virtue of a dot-screen of a particular resolution, and although the nature of such a screen will have a great effect on the absolute appearance of the halftone, as long as the same type of halftone screen is used for each test, any common halftone screen may be used. Both the solid area and halftone density may be readily measured by optical sensing systems which are familiar in the art. As shown, a densitometer or BTAC sensor 74 is used after the developing step to measure the optical density of a halftone density test patch created on the photoreceptor 20 in a manner known in the art. Systems for measuring the true optical density of a test patch are shown in, for example, U.S. Pat. No. 4,989,985 and U.S. Pat. No. 5,204,538, both assigned to the assignee hereof and incorporated by reference herein.

Figure 5:
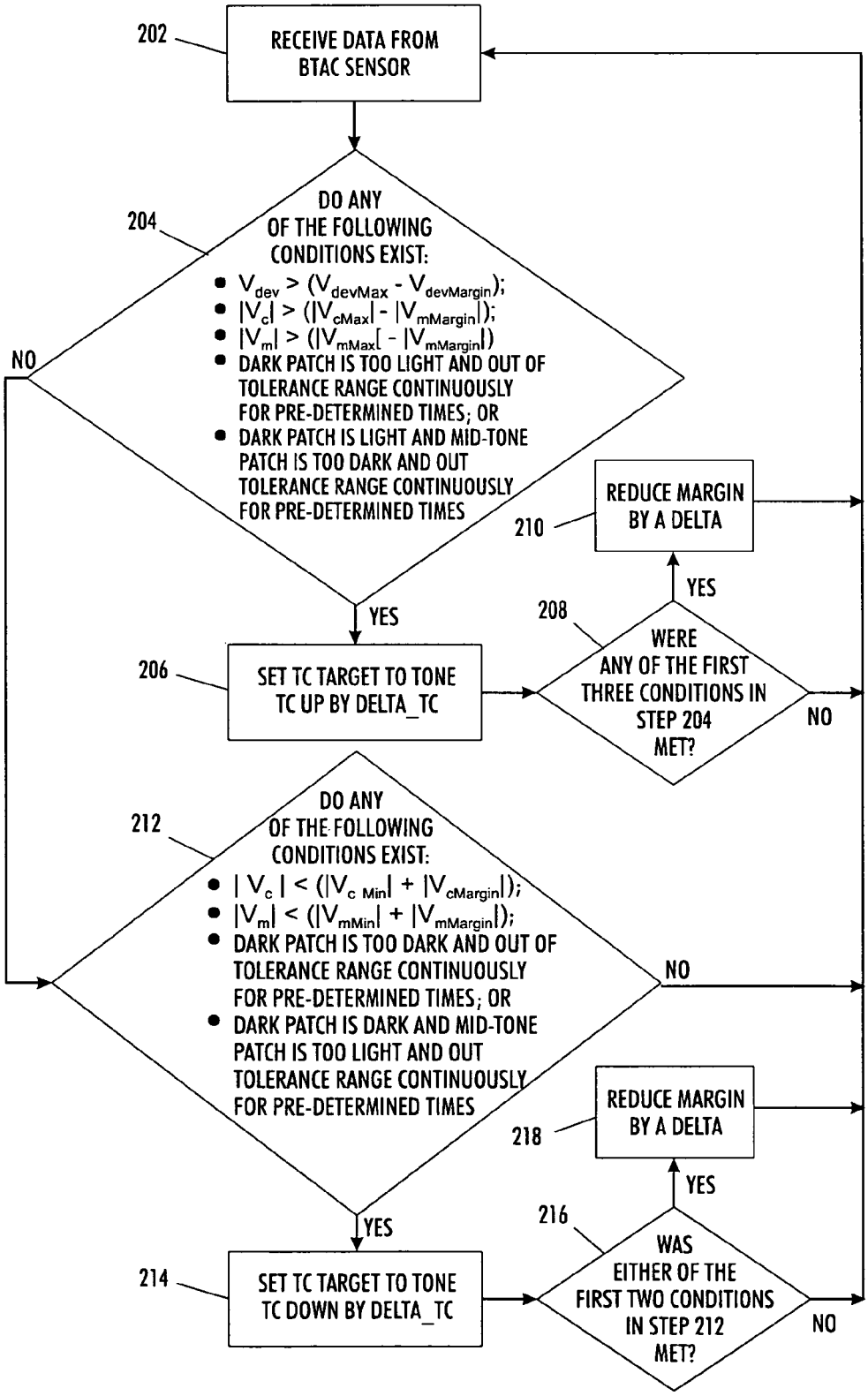
FIG. 5 is a flowchart outlining one exemplary method of using toner concentration as an active actuator in the TRC controller to maintain the TRC of the output.

FIG. 5 provides a flow chart illustrating steps of an exemplary TRC control method (i.e., a TRC controller) suitable for meeting objectives of the present exemplary embodiment. Initially, in step 202, three different half-tone patches (12.5%, 50%, 87.5%) are produced in the photoreceptor ID zone. The BTAC sensor 74 is used to monitor the relative reflectance (RR) of each of the 12.5, 50 and 87.5% area coverage halftone patches. Five control actuators may be used to control the RR of each of these patches: $V_{mag}$, $V_C$, $V_{DAC}$, exposure, and TC.

In this exemplary method, the TRC controller uses toner concentration (TC) as an active actuator and adjusts toner concentration up or down properly. The following steps trigger toner concentration movement.

Each time after the TRC controller gets data from the BTAC sensor 74 and updates the control actuators, a number of conditions are checked. $V_{dev}$ represents the charge difference which drives the movement of toner to the photoreceptor.

Thus, in step 204, the TRC controller checks if any of the following conditions exists:

a. $V_{dev}>(V_{devMax}-V_{devMargin})$;

b. $|V_c|>(|V_{c\ Max}|-|V_{c\ Margin}|)$;

c. $|V_m|>(|V_{mMax}[-|V_{mMargin}|)$;

d. Dark patch is too light and out of the tolerance range continuously for TBD times (where TBD represents a predetermined number that is stored in non-vulnerable memory or NVM; e.g., determine whether the dark patch is out of range 10 times in a row); or e. Dark patch is light and mid-tone patch is too dark and out of the tolerance range continuously for TBD (NVM) times.

If at least one of these conditions exists, then the TC target will be set to tone TC up by delta_TC, which is stored in non-vulnerable memory (step 206). By toning up, this allows the machine control actuators to achieve the desired patch targets without having to increase their levels. The print engine 10 will keep running as usual, but will not allow the TC target to move again until toner concentration converges.

Next, a determination is made as to whether the TC movement was triggered by any one of conditions (a) to (c) described above (step 208). If so, then the respective "margin" will be reduced by a delta to prevent TC from moving again (step 210). The "margin" is an actuator boundary at which a TC move will be triggered at some pre-determined level away from the actuator's limit.

However, if none of the conditions (a) to (e) exist, then, in step 212, the TRC controller checks if any of the following additional conditions exists:

f. $|V_c|<(|V_{c\ Min}|+|V_{cMargin}|)$;

g. $|V_m|<(|V_{mMin}|+|V_{mMargin}|)$;

h. Dark patch is too dark and out of the tolerance range continuously for TBD (NVM) times; or i. Dark patch is dark and mid-tone patch is too light and out of the tolerance range continuously for TBD (NVM) times.

If any one of these four conditions exists, then the TC target will be set to tone TC down by delta_TC (NVM) (step 214). The print engine 10 will keep running as usual, but will not allow the TC target to move again until TC converges.

Next, a determination is made as to whether the TC movement was triggered by conditions (f) or (g) above (step 216). If so, then the respective "margin" will be reduced by a delta to prevent TC from moving again (step 218).

In order to prevent TC from changing too much to cause any xerographic or image quality issues, there is a low boundary and a high boundary for the total TC movement around its nominal. The TC is not allowed to move to a level which is too high or too low, depending on the current environmental conditions at which the machine is running.

Test results indicate that this exemplary embodiment has helped to significantly reduce the shutdown rate and the unscheduled maintenance (UM) rate of process controls, to maintain the TRC of the output, and to increase productivity. Thus, when the relative reflectances are out of the tolerance ranges and the actuators are moving toward divergence to compensate, TC will move to compensate the TRC, so that the actuators will either recover or stop diverging and the TRC will stay within the tolerance range.

The exemplary TRC control method (i.e., the TRC controller) disclosed above operates through embedded software in the printing machine 10. This exemplary method utilizes a system having an electrostatic voltmeter (ESV) and an infrared densitometer, such as a BTAC sensor, and a toner concentration (TC) sensor. Because charge area potential is affected somewhat by the environment, and the individual differences between photoreceptors, the developer charge amount varies with changes in humidity and with degradation of the developer. For example, as developer material sits idle for a long period of time, for example, 24 hours or more, the charge between the developer material particles, i.e., toner and carrier particles, becomes weak. This weakness is aggravated even more when the humidity increases. The net effect is that the initial copies become darker than expected, resulting in relatively poor copy quality. As a result, the systems and methods according to this exemplary embodiment may also provide for sensing temperature and relative humidity in using these factors to help control the toner concentration.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method of controlling the tonal reproduction curve (TRC) and maintaining toner concentration (TC) within the latitude range of an electrophotographic print engine with a TC target, the method comprising:

setting the level of a trigger point, wherein the trigger point comprises an actuator boundary at which a TC move will be triggered at some pre-determined level away from the actuator's limit;

receiving data from a sensor;

determining whether any one of a first set of conditions exists;

setting the TC target to tone TC up by delta TC, where any one of the first set of conditions exists, wherein the first set of conditions includes $V_{dev}>(V_{devMax}-V_{devMargin})$, $|V_c|>(|V_{c\ Max}|-|V_{c\ Margin}|)$, $|V_m|>(|V_{mMax}|-|V_{mMargin}|)$, a dark patch with Cin between 70% and 100% is too light and out of the tolerance range continuously for a predetermined number of times, and the dark patch is light and a mid-tone patch with Cin between 40% and 60% is too dark and out of the tolerance range continuously for a predetermined number of times;

determining whether any of any of a second set of conditions exists; and setting the TC target to tone TC down by delta TC, where any one of the second set of conditions exists, wherein the second set of conditions includes $|V_c|<(|V_{c\ Min}|+|V_{cMargin}|)$, $|V_m|<(|V_{mMin}|+|V_{mMargin}|)$, a dark patch with Cin between 70% and 100% is too light and out of the tolerance range continuously for a predetermined number of times, and the dark patch is light and a mid-tone patch with Cin between 40% and 60% is too dark and out of the tolerance range continuously for a predetermined number of times.

2. The method defined in claim 1, further comprising reducing the level of the trigger point by a delta where any one of the conditions $V_{dev}>(V_{devMax}-V_{devMargin})$, $|V_c|>(|V_{c\ Max}|-|V_{c\ Margin}|)$, or $|V_m|>(|V_{mMax}|-|V_{mMargin}|)$ is met.

3. The method defined in claim 1, further comprising reducing the level of the trigger point by a delta where any one of the conditions $|V_c|<(|V_{c\ Min}|+|V_{cMargin}|)$ or $|V_m|<(|V_{mMin}|+|V_{mMargin}|)$ is met.

4. The method defined in claim 1, wherein the sensor is a black toner area concentration (BTAC) sensor.

5. The method defined in claim 4, wherein the data includes the relative reflectance of three half-tone patches on a test patch, the half-tone patches comprising 12.5%, 50%, and 87.5%.

6. The method defined in claim 5, further comprising using a set of control actuators to control the relative reflectance of each of the three half-tone patches and Discharge Ratio (DR) of the PIDC.

7. The method defined in claim 6, wherein the set of control actuators includes $V_{mag}$, $V_c$, $V_{DAC}$, exposure, and TC, in the setup mode and in the real time operation mode.

8. A tonal reproduction curve (TRC) and toner concentration (TC) control system for a print engine with a TC target, the system comprising:

an electrostatic voltmeter;

an infrared densitometer;

a TC sensor; and software means operative on the print engine to:

set the level of a trigger point comprising an actuator boundary at which a TC move will be triggered at some pre-determined level away from the actuator's limit;

receive data from the infrared densitometer;

determine whether any one of a first set of conditions exists;

set the TC target to tone TC up by delta TC, where any one of the first set of conditions exists, wherein the first set of conditions includes $V_{dev}>(V_{devMax}-V_{devMargin})$, $|V_c|>(|V_{c\ Max}|-|V_{c\ Margin}|)$, $|V_m|>(|V_{mMax}|-|V_{mMargin}|)$, a dark patch with Cin between 70% and 100% is too light and out of the tolerance range continuously for a predetermined number of times, and the dark patch is light and a mid-tone patch with Cin between 40% and 60% is too dark and out of the tolerance range continuously for a predetermined number of times;

determine whether any of any of a second set of conditions exists; and set the TC target to tone TC down by delta TC, where any one of the second set of conditions exists, wherein the second set of conditions includes $|V_c|<(|V_{c\ Min}|+|V_{cMargin}|)$, $|V_m|<(|V_{mMin}|+|V_{mMargin}|)$, a dark patch with Cin between 70% and 100% is too light and out of the tolerance range continuously for a predetermined number of times, and the dark patch is light and a mid-tone patch with Cin between 40% and 60% is too dark and out of the tolerance range continuously for a predetermined number of times.

9. The system defined in claim 8, wherein the software means is also operative on the print engine to reduce the level of the trigger point by a delta where any one of the conditions $V_{dev}>(V_{devMax}-V_{devMargin})$, $|V_c|>(|V_{c\ Max}|-|V_{c\ Margin}|)$, and $|V_m|>(|V_{mMax}|-|V_{mMargin}|)$ is met.

10. The system defined in claim 8, wherein the software means is also operative on the print engine to reduce the level of the trigger point by a delta where any one of the conditions $|V_c|<(|V_{c\ Min}|+|V_{cMargin}|)$ or $|V_m|<(|V_{mMin}|+|V_{mMargin}|)$ is met.

11. The system defined in claim 8, wherein the infrared densitometer is a black toner area concentration (BTAC) sensor.

12. The system defined in claim 11, wherein the data includes the relative reflectance of three half-tone patches on a test patch, the half-tone patches comprising 12.5%, 50%, and 87.5%.

13. The system defined in claim 12, wherein a set of control actuators is used to control the relative reflectance of each of the three half-tone patches, the set of control actuators including $V_{mag}$, $V_c$, $V_{DAC}$, exposure, and TC.

14. The system defined in claim 8, wherein the print engine comprises a xerographic print engine.

* * * * *